US011268670B2

(12) United States Patent
Pirringer

(10) Patent No.: US 11,268,670 B2
(45) Date of Patent: Mar. 8, 2022

(54) VEHICLE HEADLAMP AND METHOD FOR ADJUSTING A LIGHT SOURCE AND AN ADD-ON OPTICAL UNIT

(71) Applicant: ZKW Group GmbH, Wieselburg (AT)

(72) Inventor: Erik Pirringer, Wieselburg (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/769,093

(22) PCT Filed: Dec. 3, 2018

(86) PCT No.: PCT/EP2018/083287

§ 371 (c)(1),
(2) Date: Jun. 2, 2020

(87) PCT Pub. No.: WO2019/110475

PCT Pub. Date: Jun. 13, 2019

(65) Prior Publication Data

US 2021/0222851 A1 Jul. 22, 2021

(30) Foreign Application Priority Data

Dec. 4, 2017 (EP) ..... 17205072

(51) Int. Cl.
*B60Q 1/00* (2006.01)
*F21S 41/29* (2018.01)
*F21S 45/47* (2018.01)

(52) U.S. Cl.
CPC ..... *F21S 41/29* (2018.01); *F21S 45/47* (2018.01)

(58) Field of Classification Search
CPC ..... F16J 15/14; Y10T 428/249997; Y10T 428/249982; Y10T 428/249995;
(Continued)

(56) References Cited

U.S. PATENT DOCUMENTS

2006/0227535 A1* 10/2006 McArthur ..... F21V 25/10 362/148
2009/0303726 A1 12/2009 Borgschulte et al.
(Continued)

FOREIGN PATENT DOCUMENTS

JP S52076286 U 6/1977
JP 2007005090 A 1/2007
(Continued)

OTHER PUBLICATIONS

International Search Report for PCT/EP2018/083287, dated Jan. 29, 2019 (4 pages).
(Continued)

*Primary Examiner* — Omar Rojas Cadima
(74) *Attorney, Agent, or Firm* — Eversheds Sutherland (US) LLP

(57) ABSTRACT

The invention relates to a vehicle headlamp (1) comprising a light source (2) and an add-on optical unit (3), wherein the light source (2) is fastened on a carrier (10), in which bores (12, 3) are provided in order to each receive a connection means (20, 21). A spacer element (30, 31) is arranged on the carrier (10). A holding bracket (40) is arranged on the spacer element (30, 31). The connection means (20, 21) is intended to connect the holding bracket (40) to the carrier (10) and is for this purpose inserted into a corresponding opening (41, 42) and into the corresponding bore (12, 13). In a first position of the holding bracket (40), in which the connection means (20, 21) is inserted into the opening (41, 42), but is not fixed, the holding bracket (40) can be moved relative to the connection means (20, 21) within the opening (41, 42) in a plane normal to an axis (22, 23) in order to allow the add-on optical unit (3) to be oriented relative to the light source (2) in the plane. The spacer element (30, 31) can be pressed together with the aid of the connection means (20, 21) by the holding bracket (40) and the carrier (10), wherein
(Continued)

Figure 1:
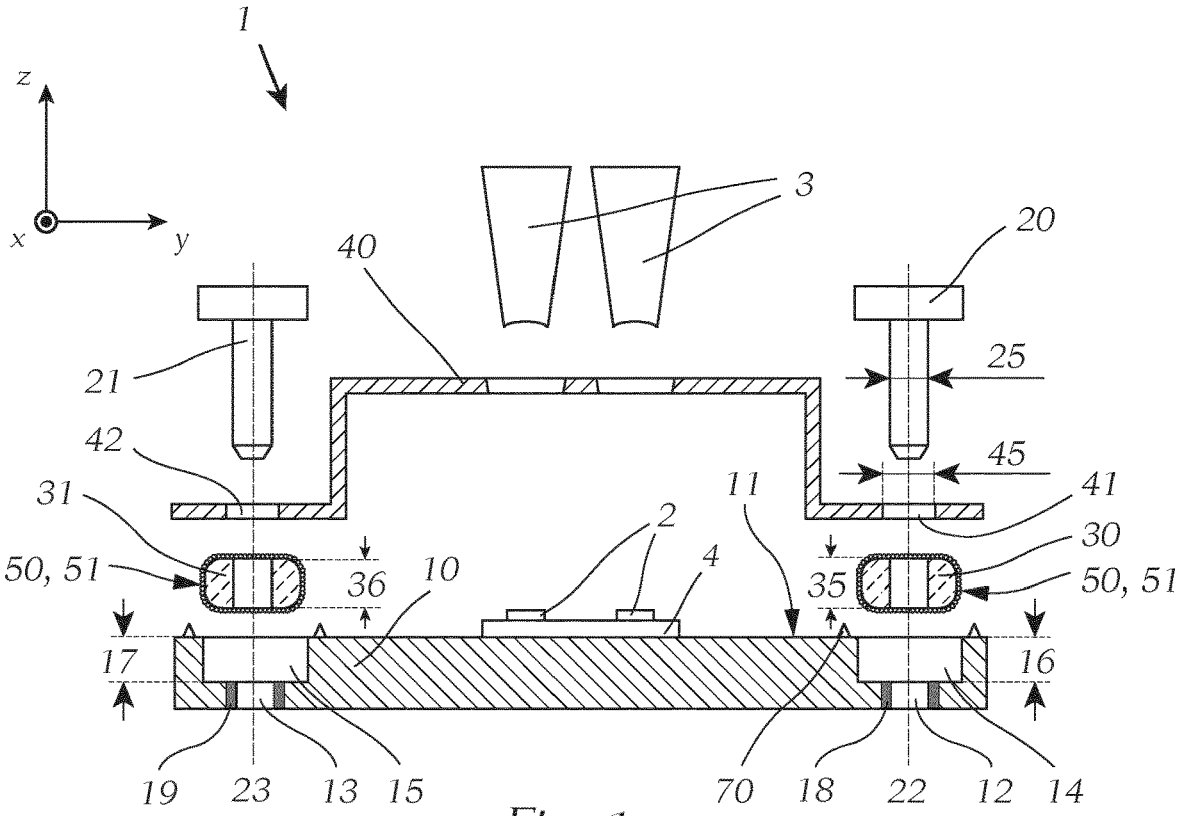

the height (35, 36) of one spacer element (30, 31) is reduced and a fixed, second position of the holding bracket (40) is achieved.

24 Claims, 3 Drawing Sheets

(58) Field of Classification Search
CPC .... Y10T 428/2982; F21V 17/12; F21V 31/00; F21V 31/005; F21Y 2115/10; F21Y 2105/10; F21S 45/10; F21S 45/50; F21W 2107/20; C08L 83/04; C08K 7/18; C08K 7/22
See application file for complete search history.

(56) References Cited

U.S. PATENT DOCUMENTS

| | | | | |
|---|---|---|---|---|
| 2010/0014286 | A1* | 1/2010 | Yoneda | F21V 5/04 362/231 |
| 2011/0096542 | A1* | 4/2011 | Yabe | H01S 5/02 362/235 |
| 2011/0175529 | A1 | 7/2011 | Hayashi et al. | |
| 2011/0188244 | A1* | 8/2011 | Hong | F21V 7/00 362/235 |
| 2014/0168996 | A1 | 6/2014 | Kajiwara et al. | |
| 2016/0040852 | A1 | 2/2016 | Zorn | |
| 2017/0370550 | A1 | 12/2017 | Japs et al. | |
| 2018/0306676 | A1 | 10/2018 | Wimmer et al. | |

FOREIGN PATENT DOCUMENTS

| | | | |
|---|---|---|---|
| JP | 2010182544 | A | 8/2010 |
| JP | 2012230983 | A | 11/2012 |
| JP | 2016139514 | A | 8/2016 |
| KR | 20100082242 | A | 7/2010 |
| WO | 2017064093 | A1 | 10/2016 |

OTHER PUBLICATIONS

Search Report for European Patent Application No. 17205072, dated Mar. 27, 2018 (1 page).

* cited by examiner

VEHICLE HEADLAMP AND METHOD FOR ADJUSTING A LIGHT SOURCE AND AN ADD-ON OPTICAL UNIT

The invention relates to a vehicle headlamp comprising a light source and an ancillary optical unit, wherein the light source is configured to emit light through the ancillary optical unit, and the ancillary optical unit is configured to focus or shape the light, and the light source is fastened on a support provided in the vehicle headlamp, in which a respective bore is provided to receive at least one connector device, and on the support at least one spacer element is provided respectively on a bearing surface, wherein the at least one spacer element has a height normal to the bearing surface, and on the at least one spacer element a holding bracket is arranged, wherein the holding bracket is fixedly connected to the ancillary optical unit and has a respective opening provided for receiving the at least one connector device, and the at least one connector device, which extends along a respective axis and is intended for connecting the holding bracket to the support, and for this purpose is inserted into the corresponding opening and into the corresponding bore.

The invention also relates to a method for the assembly and adjustment of a light source and an ancillary optical unit of a vehicle headlamp relative to one another, wherein the light source is configured to emit light through the ancillary optical unit, and the ancillary optical unit is configured to focus or shape the light.

When assembling the optical components of a vehicle headlamp, it is necessary to adjust these components relative to one another in order to achieve the desired optical function of the vehicle headlamp. Adjustment requires not only the precise alignment of the optical components relative to one another, but also ease of manipulation during the assembly method. It is also necessary for the adjustment to be permanent and particularly robust against environmental influences, such as temperature fluctuations or vibrations, during the life cycle of the vehicle headlamp. Current designs often have the disadvantage that the design is complex, the assembly leads to high costs, or that the adjustment can loosen in the course of time, or after excessive stress, and an expensive readjustment can be required.

It is the object of the invention to create a method and a vehicle headlamp of the type cited above, with which the disadvantages of the prior art are overcome.

The object is achieved by means of a vehicle headlamp of the type cited above, in which, in a first position of the holding bracket, in which the at least one connector device is inserted into the opening, but not fixed, the holding bracket can be moved relative to the at least one connector device within the opening in a plane normal to the axis, so as to enable in the plane an orientation of the ancillary optical unit fastened to the holding bracket with respect to the light source fastened to the support, and the at least one spacer element can be pressed together with the aid of the at least one connector device by the holding bracket and the support, wherein the height of the at least one spacer element is reduced, in order to align the light source and the ancillary optical unit relative to one another in the direction of the axis, and a fixed, second position of the holding bracket is achieved.

It is beneficial if the modulus of elasticity of at least one spacer element is less than the modulus of elasticity of the holding bracket and/or the support. This makes it easier to compress the at least one spacer element when the holding bracket and/or the support is pressed on.

It is particularly beneficial if the modulus of elasticity of the at least one spacer element is less than 80 $kN/mm^2$, preferably less than 30 $kN/mm^2$, particularly preferably less than 4 $kN/mm^2$ and greater than 1 $kN/mm^2$. This ensures that the at least one spacer element is easier to compress.

It is also particularly beneficial if the yield strength of the at least one spacer element is less than 100 $kN/mm^2$, preferably less than 80 $kN/mm^2$ and more than 10 $kN/mm^2$, particularly preferably less than 70 $kN/mm^2$ and more than 20 $kN/mm^2$. This ensures that the at least one spacer element is easier to compress.

In a further development of the invention, the cited limiting values for the modulus of elasticity and the yield point can be combined in order to obtain an even better attunement of the material properties of the at least one spacer element, which are particularly advantageous for the inventive arrangement.

In a further development of the invention, the vehicle headlamp comprises at least two spacer elements and at least two connector devices, wherein the at least two spacer elements are arranged such that an adjustment of the holding bracket with respect to the support can be achieved, in the course of which the at least two spacer elements each have a different height in the adjusted position. This ensures that assembly influences, such as those of the light sources or the ancillary optical unit, can easily be compensated.

It is beneficial if a circuit board is arranged between the light source and the support, on which the light source is fastened. This allows the light source easily to be electrically connected and mechanically connected to the support. The light source can comprise a plurality of lighting elements, for example in the form of semiconductor lighting elements, such as LEDs or laser diodes, which are mounted on one or more common circuit boards or circuit substrates. Conductor paths and other electronic components for purposes of controlling the light source can be comprised by the circuit board. If a plurality of lighting elements are deployed, it is often necessary to provide respective ancillary optical unit elements, for example in the form of longitudinally extended optical light guides, or optical collecting lenses. The ancillary optical unit, which can be formed from a plurality of optical elements, is fastened to a common mounting.

Furthermore, it is beneficial if a heat sink is arranged on the support, or the support itself has cooling fins or cooling pins, and the at least one light source is fastened to the support. This enables the power loss that occurs on the light source during operation to be dissipated. By means of the connection of the support to the heat sink, a mechanically stable assembly is created, which can accommodate loads; this is taken into account by means of the adjustable connection between the mounting and the support.

Alternatively, a circuit board, on which the light source is fastened, can be arranged between the light source and the heat sink. As mentioned before, the circuit board can comprise a plurality of lighting elements, other electronic components, together with conductor tracks.

In a beneficial form of embodiment of the invention, the support has a passage opening through which the light source projects.

It is advantageous if the support furthermore has at least one recess, having a respective depth which is suitable for receiving the at least one spacer element and being shaped essentially in a complementary manner to the outer contour of the at least one spacer element, wherein the height of the at least one spacer element is greater than the depth of the at least one recess. This ensures that the spacer element is already held fixedly in position before assembly.

In addition, it is advantageous if a layer is applied between the at least one spacer element and the support, and/or between the at least one spacer element and the holding bracket, and/or between the at least one connector device and the support, which layer contains an adhesive, which preferably has a fluid state. The adhesive ensures that the arrangement is fixed after an adjustment, and is resistant to any self-loosening of the connection. In the automotive environment, for example, undesirable temperature influences can occur, which can lead to a de-adjustment of the arrangement.

Moreover it is advantageous if the adhesive is embedded in a number of microcapsules, and is preferably held in a fluid carrier substrate, in which the number of microcapsules is embedded. By using a microencapsulated adhesive, for example a one-component (1K) or a two-component (2K) adhesive, it is possible to ensure that more assembly time is available for the adjustment of the arrangement than when using a conventional adhesive, which begins to cure quickly after application of the adhesive, and thus makes adjustment more difficult. By means of the above-cited recess it can also be ensured that when the at least one spacer element is compressed in the axial direction of the at least one connector device, the at least one spacer element presses itself against the wall of the recess, and thus causes the microcapsules to burst, so that the adhesive can escape and mix with the hardener of the two-component adhesive, for example, and can cure.

This can be achieved if the number of microcapsules at least partially bursts and releases the embedded adhesive by means of a force-fit connection of the support with the holding bracket, by means of the at least one connector device.

For a simple implementation it is beneficial if the at least one spacer element respectively has a spacer element opening, and preferably has a toroidal shape, and the at least one connector device extends through the spacer element opening.

It is beneficial if the inner diameter of the opening of the holding bracket is greater than the outer diameter of the connector device. In other words, the holding bracket should be able to move around the connector device for purposes of adjustment, if the arrangement is not yet fixed.

Furthermore, it is beneficial for simple implementation if the at least one connector device is a screw, and the bore of the support preferably has a thread, which is configured to engage with the at least one connector device.

Moreover, it is beneficial if the support comprises at least one crush ridge, which is configured to engage with the holding bracket in the adjusted state. This ensures that the adjustment of the arrangement can take place in the plane normal to the axial direction of the at least one connector device, and when the force exerted by the at least one connector device is increased, the arrangement is fixed in the plane, before an adjustment takes place in the axial direction of the at least one connector device. This sequence facilitates the adjustment method considerably.

The object is also achieved by a corresponding method. The method relates to the assembly and adjustment of a light source and an ancillary optical unit of a vehicle headlamp relative to one another, wherein the ancillary optical unit is configured to focus or shape the light emitted by the light source, wherein the vehicle headlamp furthermore comprises a support and a holding bracket, and the following method steps are executed:

arranging and fixing the light source in the region of a bearing surface of the support, in which a bore is provided for receiving at least one connector device, which extends in a longitudinal direction, and has an axis in the direction of the longitudinal extent, arranging at least one spacer element on the support, and of a holding bracket on the spacer element, wherein the holding bracket is fixedly connected to the ancillary optical unit, and has at least one opening, which is provided for receiving the at least one connector device, inserting the at least one connector device into the respective opening and into the respective bore, establishing an initial adjustment state by orienting the ancillary optical unit relative to the light source in an XY-plane, which is defined normal to the axis, setting the initial adjustment state in the XY-plane by connection of the support and the holding bracket by exerting a first force using the at least one connector device, wherein a first adjustment state with a first adjustment height is achieved, establishing a third adjustment state in the XY-plane and in the direction of the axis by exerting a third force using the connector device between the support and the holding bracket, wherein a third adjustment height is achieved.

If necessary, the sequence of the individual method steps can be adapted for different forms of embodiment in accordance with the respective requirements. However, the method should preferably be executed in the above sequence.

The inventive method ensures that at least one light source and at least one ancillary optical unit of a vehicle headlamp can be assembled and adjusted relative to one another particularly easily.

In a further development of the invention, the cited limiting values for the modulus of elasticity and the yield point can be combined to obtain an even better attunement of the material properties of the at least one spacer element, which are particularly advantageous for the inventive arrangement.

It is advantageous if an activatable adhesive is applied to the outer surface of the at least one spacer element, before the step of the insertion of the at least one connector device, and the following step is performed before the step of establishing a third adjustment state:

establishing a second adjustment state, wherein the adhesive is activated by exertion of a second force, by means of the connector device, between the support and the holding bracket, and a second adjustment height is achieved, and the following step is performed after the step of establishing a third adjustment state:

setting the third adjustment state in the XY-plane and in the direction of the axis at the third adjustment height by curing of the activated adhesive.

By the use of an adhesive, it can be ensured that the entire arrangement remains fixed for a long period of time, even after an adjustment has been made during operation of the vehicle, during which, for example, mechanical and thermal influences can have an adverse effect on the adjustment of the arrangement.

The adhesive is present in an activatable form in the unassembled arrangement. For example, a two-component (2K) adhesive is inactive until the adhesive and the hardener of the 2K adhesive come into contact. Alternatively, a one-component (1K) adhesive is inactive until the 1K adhesive can react with ambient air and cure. Where the method provides for the use of an activatable adhesive, the person carrying out the adjustment and assembly has sufficient time for the adjustment and assembly. Only after the adhesive has been activated must the adjustment be completed quickly so that the curing of the adhesive bond can take place in a reliable manner.

It is furthermore beneficial if the adhesive wets the outer surface of the spacer element.

In a preferred further development of the invention it is beneficial if between the at least one spacer element and the support, and/or between the at least one spacer element and the holding bracket, and/or between the at least one connector device and the support, a layer is applied, which contains an activatable adhesive, which preferably is in a fluid state. This enables the entire connection to be permanently fixed.

Furthermore it is beneficial if the adhesive is embedded in a number of microcapsules, and is preferably held in a fluid carrier substrate in which the number of microcapsules is embedded, and the number of microcapsules at least partially bursts when a mechanical force is applied to the microcapsules and releases the embedded adhesive. By this means a simple implementation is achieved. At the mechanical force at which the microcapsules burst, all forces that fulfil a function and act during the adjustment and assembly of the entire arrangement can be measured.

For the adjustment and assembly method it is also true that it is advantageous if the modulus of elasticity of at least one spacer element is less than the modulus of elasticity of the holding bracket and/or the support.

Furthermore, it is also beneficial for the method if the modulus of elasticity of the at least one spacer element is less than 80 $kN/mm^2$, preferably less than 30 $kN/mm^2$, particularly preferably less than 4 $kN/mm^2$ and greater than 1 $kN/mm^2$.

It is also advantageous for the method if the yield strength of the at least one spacer element is less than 100 $kN/mm^2$, preferably less than 80 $kN/mm^2$ and greater than 10 $kN/mm^2$, particularly preferably less than 70 $kN/mm^2$ and greater than 20 $kN/mm^2$.

In a further development of the invention, the cited limiting values for the modulus of elasticity and the yield point can be combined in order to obtain an even better attunement of the material properties of the at least one spacer element, which are particularly advantageous for the inventive method.

Figure 2:
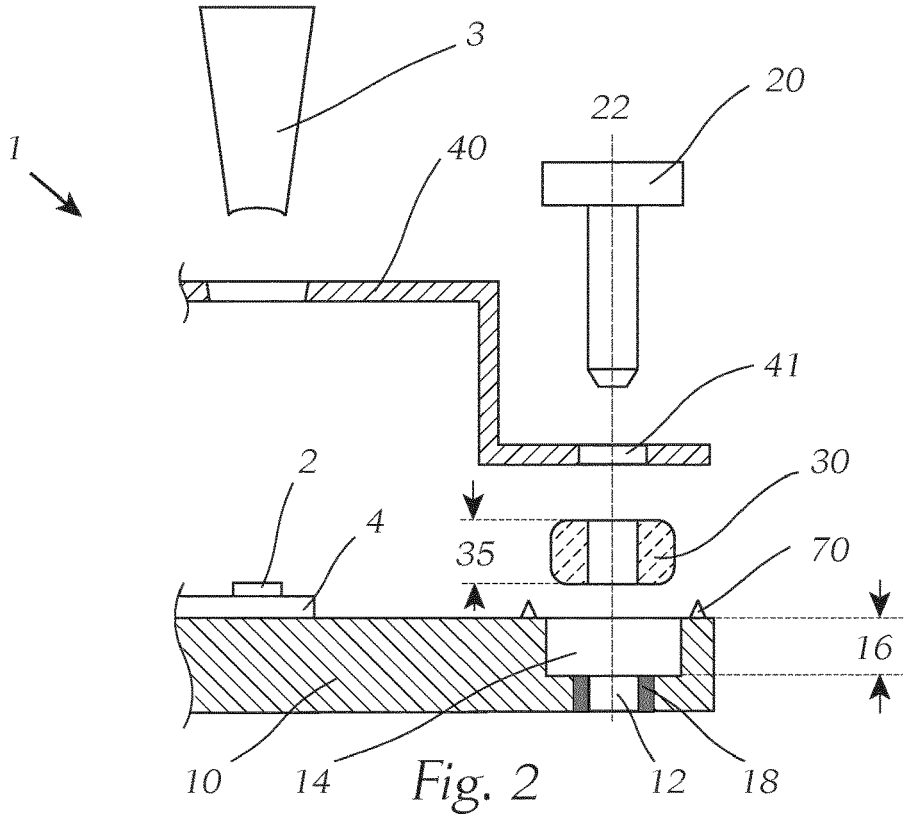
Figure 3:
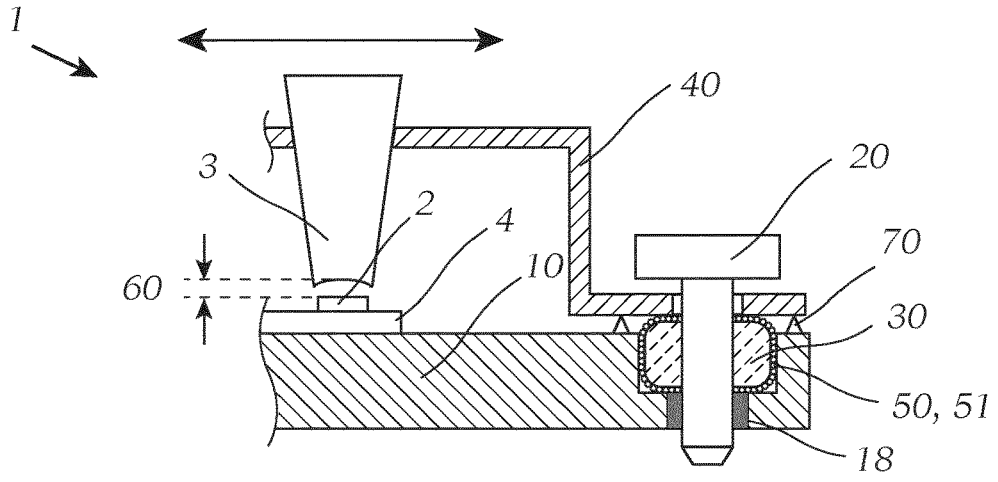
Figure 4:
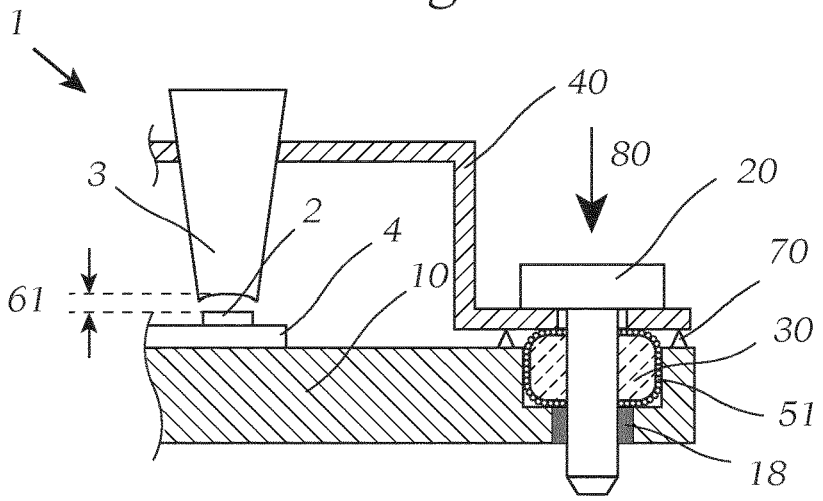
Figure 5:
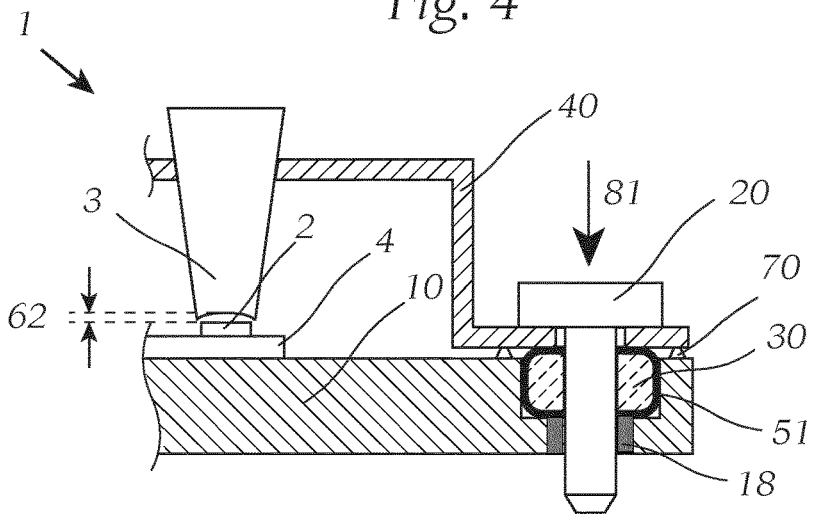
Figure 6:
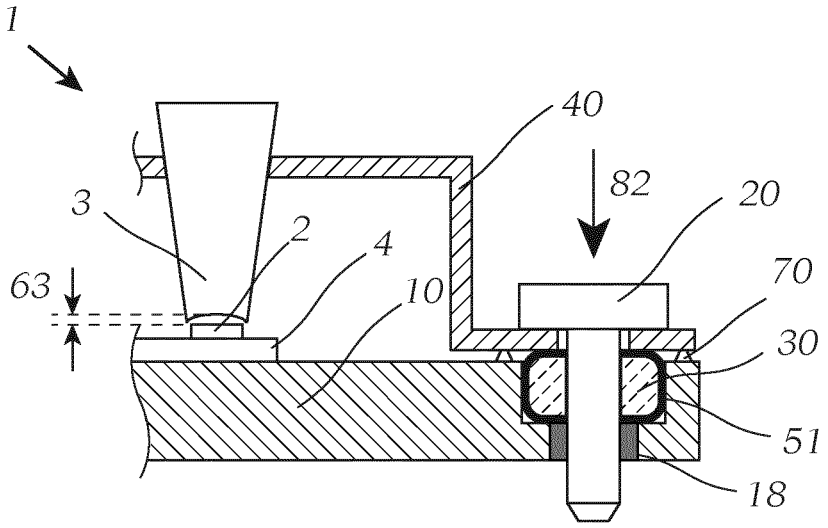
Figure 7:
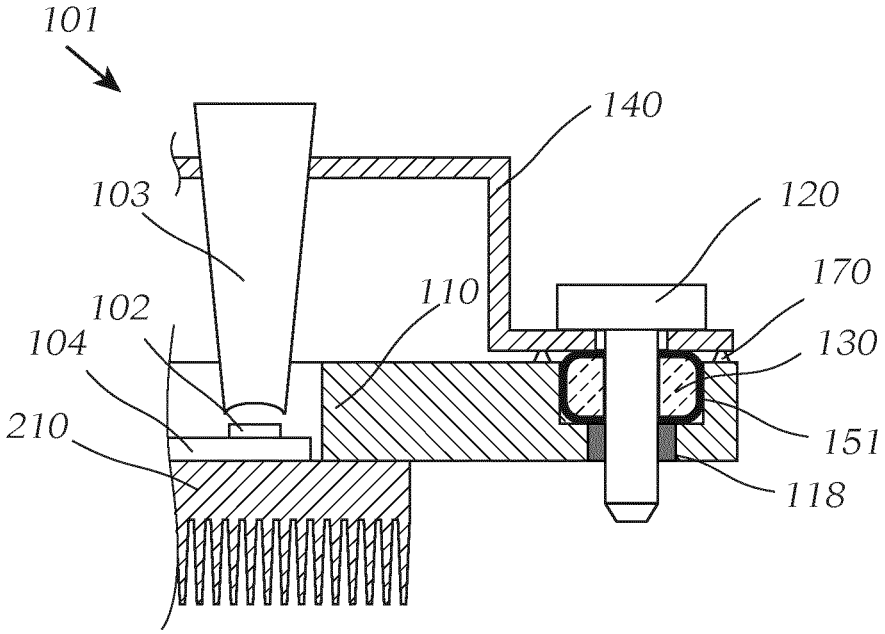

The invention and its advantages are described in more detail in what follows with the aid of a non-restrictive example of embodiment, which is illustrated in the accompanying figures. In the figures:

FIG. 1 shows an exploded view of an example of embodiment of a vehicle headlamp, which can be assembled in accordance with the inventive adjustment method, FIG. 2 shows an enlarged detail of FIG. 1, which shows the initial state of the inventive adjustment method, FIG. 3 shows a first method step with an initial adjustment state, in which the arrangement is assembled, and a first adjustment is made, FIG. 4 shows a further method step with a first adjustment state, in which the adjustment is settled, FIG. 5 shows a subsequent method step with a second adjustment state, in which the adhesive is activated for the adjustment, FIG. 6 shows a final method step with a third adjustment state, FIG. 7 shows a cross-sectional view of another example of embodiment, in which the support comprises an additional heat sink.

With reference to FIGS. 1 to 7, examples of embodiment of the invention are now explained in more detail. In particular, parts in a headlamp that are important for the invention are shown, wherein it is clear that a headlamp contains many other parts, not shown, which enable a useful deployment in a motor vehicle, such as, in particular, a car or a motorcycle. For the sake of clarity, for example, cooling devices for components, control electronics, other optical elements, mechanical adjustment devices, or mountings, are therefore not shown.

FIGS. 1 to 3 show a vehicle headlamp 1 comprising a light source 2 and an ancillary optical unit 3, wherein the light source 2 is configured to emit light through the ancillary optical unit 3, and thereby to focus or shape it.

In FIG. 1 an XYZ-coordinate system is also specified, on the basis of which an adjustment of the inventive arrangement is to be made.

The light source 2 is fastened on a support 10 provided in the vehicle headlamp 1, in which support a bore 12 and 13 is respectively provided for receiving two connector devices 20 and 21.

The light source 2 can be formed from a plurality of optoelectronic components, preferably from LEDs or laser diodes. Here a plurality of light elements of the light source 2 can be deployed for different lighting functions of the vehicle headlamp 1 and in this sense can be operated in a different manner.

Between the light source 2 and the support 10 is arranged a circuit board 4, on which the light source 2 is fastened. Contact pads and conductor paths (not shown), for the electrical connection of the light source 2, can be located on the circuit board. The light source 2 is preferably electrically and mechanically connected to the contact connection surfaces by means of solder or adhesive.

In this example of embodiment, the connector devices 20, 21 are screws, and the bores 12, 13 of the support 10 have respective internal threads, configured to engage with the two connector devices 20, 21, which have respective complementary external threads. In principle, the connector devices can also be other suitable elements, such as a rivet. Alternatively, the connector devices 20, 21 can also be threaded rods, for example, which are adjustably bounded on both sides by means of nuts.

Moreover, the support 10 comprises a plurality of crush ridges 70, which are configured to engage with the holding bracket 40 in an adjusted state. The crush ridges 70 are not absolutely necessary, but they do facilitate the subsequent adjustment of the assembly by enabling an alignment in an XY-plane, which is located normal to the longitudinal extent of the connector devices 20, 21, to be fixed in a first step, by allowing the lateral coefficient of friction to be increased by the crush ridges 70. The crush ridges 70 can be shaped from needle-like, circular or linear elements, and can be formed from one or a plurality of such elements.

Furthermore, two spacer elements 30, 31 are arranged on the support 10, respectively in the region of a bearing surface 11, wherein the two spacer elements 30, 31 each have heights 35, 36 normal to the bearing surface 11.

The two spacer elements 30, 31 are arranged such that an adjustment of the holding bracket 40 with respect to the support 10 can be achieved, in which, in an adjusted position, the two spacer elements 30 and 31 can each have a different height 35 and 36.

The support 10 furthermore has two cavities 14 and 15, with respective depths 16 and 17, which are provided for receiving a respective spacer element 30, 31, and are shaped in an essentially complementary manner to the outer contour of the at least one spacer element 30, 31, wherein the heights 35, 36 of the two spacer elements 30 and 31 are greater than the depths 16 and 17 of the two cavities 14 and 15. The depths 16 and 17 of the cavities 14 and 15 are preferably of equal size.

Alternatively, the recess can also be embodied as a blind hole that does not extend completely through the support, and has a thread for receiving a connector device in the form of a screw.

In principle, other shapes for the recess are also possible. It is advantageous if the shape of the recess corresponds to the shape of the spacer element that is to be inserted into the recess.

In some embodiments it can be beneficial if a spacer element 30, 31 consists of a plurality of spacer element units, which can, for example, be stacked on top of one another within the associated recess.

Furthermore, a holding bracket 40 is arranged on the two spacer elements 30, 31, wherein the holding bracket 40 is fixedly connected to the ancillary optical unit 3, and has respective openings 41, 42, provided for receiving the two connector devices 20, 21.

The connector devices 20, 21, each of which extends along an axis 22, 23, and is intended for the connection of the holding bracket 40 to the support 10, for this purpose are inserted into the respective opening 41, 42 and into the respective bore 12, 13.

The bores 12 and 13 have respective threads 18, 19 so as to receive the threads of the respective screws 20, 21.

With reference to FIGS. 3 to 6, the adjustment of the arrangement is now described in more detail, wherein only one connector device 20 from FIG. 1 is shown, with the associated bore 12, thread 18, recess 14 and axis 22. Needless to say, the same applies for the connector device 21 with the corresponding bore 13, thread 19, recess 15, and axis 23, which can be seen in FIG. 1.

In a first position of the holding bracket 40, in which the two connector devices 20, 21 are inserted into the openings 41, 42, but are not fixed, the holding bracket 40 can be moved with respect to the two connector devices 20 and 21 within the openings 41 and 42 in a plane normal to the axes 22 and 23, in order to enable an orientation in the plane of the ancillary optical unit 3 fastened to the holding bracket 40 with respect to the light source 2 fastened on the support 10. In this example the adjustment plane is the XY-plane of FIG. 1, which is also shown in the other figures.

The adjustment in the XY-plane can be made within a range that is limited by the distance between the outer diameter 25 of the connector devices 20, 21 and the inner diameter 45 of the openings 41, 42 of the holding bracket 40. In other words, the holding bracket 40 can move within its openings 41, 42 around the connector devices 20, 21 in an unfixed, but assembled state, since the inner diameter 45 of the openings 41, 42 is greater than the outer diameter 25 of the connector devices 20, 21.

The two spacer elements 30, 31 can be pressed together, with the aid of the two connector devices 20, 21, by the holding bracket 40 and the support 10, wherein the height 35, 36 of the two spacer elements 30, 31 is reduced in order to align the light source 2 and the ancillary optical unit 3 relative to one another in the direction of the axes 22, 23, and a fixed, second position of the holding bracket 40 is achieved.

The two spacer elements 30, 31 can be covered on their surface by a layer, which comprises an adhesive 51 in fluid consistency, which is embedded in a number of microcapsules 50 in a substrate of the layer. The microcapsules 50 are held in an initially fluid carrier substrate, which dries after it has been applied to the spacer elements 30, 31, thus facilitating the assembly and adjustment of the arrangement.

The adhesive 51 can have a fluid consistency, for example a liquid, paste or gel. A number of small drops of the adhesive 51 is surrounded by a respective shell, forming microbeads 50.

When a force is applied to the shell of the microbeads 50, the microbeads 50 can burst, and the trapped adhesive 51 can escape. The adhesive can be cured by exposure to ambient air. Alternatively, the adhesive 51 can be formed from two adhesive components of a two-component adhesive, which can be separately contained in different microbeads 50, and which react only by means of mutual contact after the shell of the microbeads 50 has been burst. As a consequence, the two adhesive components can mix and the adhesive mixture can cure.

By the application of a greater amount of force, that is to say, by means of a force-fit connection of the support 10 to the holding bracket 40 by means of the two connector devices 20, 21, the number of microcapsules 50 can at least partially burst and release the embedded adhesive 51.

The two spacer elements 30, 31 each have a spacer opening and are toroidal in shape. The two connector devices 20, 21 traverse the spacer element opening. In this context, a toroidal shape means that the shape can also be that of a truncated cone, and it is not relevant if, for example, edges are not precisely formed. The openings 41, 42 of the at least one holding bracket 40 have a cross-section that is less than that of the cavities 14, 15. Furthermore the inner diameter 45 of the openings 41, 42 is greater than the outer diameter 25 of the connector devices 20, 21. This ensures that the holding bracket 40 can be adjusted in a plane that is transverse to the axes 22, 23, as long as the arrangement is not yet fixed by the connector devices 20, 21, that is to say, a form-fit connection has not yet been achieved, as a result of which the frictional forces during a lateral movement of the holding bracket 40 with respect to the spacer element 30, 31 or the support 10 prevent any further lateral movement and thus a first adjustment is achieved.

An acting force 81 is transferred from the spacer elements 30, 31 to the microbeads 50, and the microbeads 50 burst at a predetermined force level. It is clear that here the microbeads 50 that are located on the end faces of the spacer elements 30, 31 are more likely to burst. However, due to the compression of the spacer elements 30, 31 by the acting force 81, it is also possible for the spacer elements 30, 31 to expand laterally, as a result of which laterally located microbeads 50 can also burst and the adhesive 51 can escape. This effect can be improved, for example, if the spacer elements 30, 31 have a tapered shape of a truncated cone on their outer surfaces, and thus subject the laterally located microbeads 51 to increased contact pressure.

It is clear that not all microbeads 50 must burst in order to achieve a sufficient adhesive effect as a result of the adhesive 51 that has leaked from the burst microbeads 50.

The adhesive 51 is of known art from the technology of thread locking by means of adhesive. Microencapsulated adhesives present themselves as a dry, non-slip, lacquer-like coating. The adhesive starts to cure immediately after the breaking open of the shell. Since current products take the form of fast curing systems, measurable results are achieved after only 10-15 minutes. Curing is fully complete after 24 hours, but can be accelerated by exposure to temperature. After the curing, the desired fixing or securing action is fully achieved, while at the same time an additional sealing effect is obtained.

Depending on the application, it can be necessary to use a plurality of such arrangements, which respectively comprise the above-described supports 10, screws 20, spacer elements 30 and mountings 40, for the fixing and adjustment.

In summary, the above-cited method, as shown in FIGS. 1 and 3 to 6, for the assembly and adjustment of a light source 2 and an ancillary optical unit 3 of a vehicle headlamp 1 relative to one another, wherein the ancillary optical unit 3 is configured to focus or shape the light emitted by the light source 2, wherein the vehicle headlamp 1 furthermore comprises a support 10 and a holding bracket 40, can be described in terms of the implementation of the following method steps:

arranging and fixing the light source 2 in the region of a bearing surface 11 of the support 10, in which a bore 12, 13 is provided for receiving connector devices 20 and 21, for example screws, which respectively extend in a longitudinal direction, and have respective axes 22, 23 in the direction of the longitudinal extent, arranging spacer elements 30 and 31 on the support 10, and arranging a holding bracket 40 on the spacer elements 30 and 31, wherein the holding bracket 40 is fixedly connected to the ancillary optical unit 3, and has an opening 41 and 42, which is respectively provided for receiving the connector devices 20 and 21, inserting the connector devices 20, 21 into the respective openings 41, 42, and into the respective bores 12 and 13, wherein an activatable adhesive 51 is applied to the outer surface of the spacer elements 30, 31, and/or to the connector devices 20, 21, establishing an initial adjustment state with an initial adjustment height 60 by orientation of the ancillary optical unit 3 relative to the light source 2 in an XY-plane, which is defined normal to the axes 22, 23, setting the initial adjustment state in the XY-plane by connection of the support 10 and the holding bracket 40 by exertion of a first force 80 by means of the at least one connector device 20, 21, wherein a first adjustment state with a first adjustment height 61 is achieved, establishing a second adjustment state, wherein the adhesive 51 is activated by exertion of a second force 81 by means of the connector devices 20, 21 between the support 10 and the holding bracket 40, and a second adjustment height 62 is achieved, establishing a third adjustment state in the XY-plane and in the direction of the axes 22, 23 by exertion of a third force 82 by means of the connector devices 20, 21 between the support 10 and the holding bracket 40, wherein a third adjustment height 63 is achieved, setting the third adjustment state in the XY-plane and in the direction of the axes 22, 23 at the third adjustment height (63) by curing of the activated adhesive 51.

FIG. 3 shows the initial adjustment state with the initial adjustment height 60, which is set without the application of a force 80, and wherein an adjustment is made in the XY-plane.

FIG. 4 shows the first adjustment state with the first adjustment height 61, which is achieved by the application of the first force 80. The first adjustment state is an intermediate state, which serves to prevent the arrangement from slipping in the XY-plane by the application of the first force 80, which was achieved by the step shown in FIG. 3.

In FIG. 5 the second adjustment state is shown with the second adjustment height 62, which is achieved by the application of the second force 81. The second adjustment state is an intermediate state, which serves, by the application of the second force 81, to activate the adhesive 51 by bursting of the microcapsules 50.

In FIG. 6 the third adjustment state is shown with the third adjustment height 62, which is achieved by the application of the third force 82. The third adjustment state is a final state, which serves to fix the arrangement after the adhesive 51 has cured.

In this context, it is clear that the adhesive 51 does not have to fully wet all or individual surfaces in order to achieve a fixing action.

Before arranging the spacer elements 30, 31, a layer is applied between the spacer elements 30, 31 and the support 10, and/or between the spacer elements 30, 31 and the holding bracket 40, and/or between the connector devices 20, 21 and the support 10, which comprises an activatable adhesive 51, which preferably is in fluid state.

The adhesive 51 is embedded in a number of microcapsules 50, and is preferably held in a fluid carrier substrate in which the number of microcapsules 50 is embedded, and the number of microcapsules 50 at least partially bursts when a mechanical force, corresponding to the above-cited second force 81 in the method, is applied to the microcapsules 50 and releases the embedded adhesive 51.

The modulus of elasticity of the spacer elements 30, 31 is less than the modulus of elasticity of the holding bracket 40, and/or that of the support 10.

The modulus of elasticity of the spacer elements 30, 31 is less than 80 $kN/mm^2$, as is the case, for example, with aluminium, preferably less than 30 $kN/mm^2$, particularly preferably less than 4 $kN/mm^2$, and greater than 1 $kN/mm^2$, as is the case, for example, with plastics.

The yield point of the spacer elements 30, 31 is less than 100 $kN/mm^2$, as is the case, for example, with aluminium, preferably less than 80 $kN/mm^2$, as is the case, for example, with plastics, and greater than 10 $kN/mm^2$, particularly preferably less than 70 $kN/mm^2$ and greater than 20 $kN/mm^2$.

The material of the spacer elements 30, 31 can be, for example, a plastic such as polyamide PA, polycarbonate PC, ABS, polypropylene PP, polystyrene PS or special thermoplastics, but can also be a soft metal such as aluminium.

The material of the support 10 can be, for example, a metal such as aluminium, copper or brass, the holding bracket 40 can, for example, be made of a plastic such as PC, ABS or PS, or of a metal such as aluminium or an alloy such as brass or sheet steel, wherein the above-mentioned material properties are preferably present. A good thermal conductivity of the material of the support 10 is advantageous.

The material of the holding bracket 40 can be, for example, a plastic with a high modulus of elasticity such as PC or PS, but can also be a metal such as aluminium or sheet steel. A high modulus of elasticity of the material is advantageous.

FIG. 7 shows a cross-sectional view of a further example of embodiment of the invention. A headlamp 101 has a support 110, which is fixedly connected to a separately formed heat sink 210. It would also be conceivable that the support 110 and the heat sink 210 form a common, connected component. In other words, the support can itself have cooling fins or cooling pins, for example.

The vehicle headlamp 101 comprises a light source 102 and an ancillary optical unit 103, wherein the light source 102 is configured to emit light through the ancillary optical unit 103, thereby focusing or shaping it.

Furthermore the embodiments of the arrangement and method of the preceding figures apply.

LIST OF REFERENCE SYMBOLS

1, 101 Vehicle headlamp
2, 102 Light source
3, 103 Ancillary optical unit
4, 104 Circuit board
10, 110 Support
11 Bearing surface
12, 13 Bore
14, 15 Recess
16, 17 Depth of the recess
18, 19, 118 Thread in the bore of the support
20, 21, 120 Connector device
22, 23 Axis of the connector device
25 Outer diameter of the connector device
30, 31, 130 Spacer element
35, 36 Height of the spacer element
40, 140 Holding bracket
41, 42 Opening
45 Inner diameter of the opening
50 Microcapsule
51, 151 Adhesive
60, 61, 62, 63 Adjustment height
70, 170 Crush ridge
80, 81, 82 Acting or generated force
210 Heat sink

The invention claimed is:

1. A vehicle headlamp comprising:

a light source; and an ancillary optical unit, wherein the light source is configured to emit light through the ancillary optical unit, and the ancillary optical unit is configured to focus or shape said light, and wherein:

the light source is fastened on a support provided in the vehicle headlamp and in which one bore is respectively provided for receiving at least one connector device, at least one spacer element is arranged on the support respectively on a bearing surface, wherein the at least one spacer element has a height normal to the bearing surface, a holding bracket is arranged on the at least one spacer element, the holding bracket being fixed to the ancillary optical unit and having a respective opening provided for receiving the at least one connector device, the at least one connector device, which extends along a respective axis, is configured for connecting the holding bracket to the support, and is, for this purpose, inserted into the respective opening and the respective bore, in a first position of the holding bracket, in which the at least one connector device is inserted into the opening, but is not fixed, the holding bracket can be moved with respect to the at least one connector device within the opening within a plane normal to the axis, in order to enable an orientation in the plane of the ancillary optical unit fastened to the holding bracket with respect to the light source fastened on the support, and the at least one spacer element is compressible by the at least one connector device through the holding bracket and the support, wherein the height of the at least one spacer element decreases, to achieve a fixed, second position of the holding bracket, wherein the at least one spacer element in the fixed, second position holds the support and the holding bracket at a distance from one another in order to position the light source and the ancillary optical unit in a desired alignment with respect to one another.

2. The vehicle headlamp according to claim 1, wherein the modulus of elasticity of the at least one spacer element is less than the modulus of elasticity of the holding bracket and/or the support, wherein:

the modulus of elasticity of the at least one spacer element is less than 80 $kN/mm^2$, and the yield point of the at least one spacer element is less than 100 $kN/mm^2$.

3. The vehicle headlamp according to claim 2, wherein the modulus of elasticity of the at least one spacer element is less than 30 $kN/mm^2$ and greater than 1 $kN/mm^2$.

4. The vehicle headlamp according to claim 2, wherein the modulus of elasticity of the at least one spacer element is less than 4 $kN/mm^2$.

5. The vehicle headlamp according to claim 2, wherein the yield point of the at least one spacer element is less than 80 $kN/mm^2$ and greater than 10 $kN/mm^2$.

6. The vehicle headlamp according to claim 2, wherein the yield point of the at least one spacer element is less than 70 $kN/mm^2$ and greater than 20 $kN/mm^2$.

7. The vehicle headlamp according to claim 1, wherein the vehicle headlamp comprises at least two spacer elements and at least two connector devices, wherein the at least two spacer elements are arranged such that an adjustment of the holding bracket with respect to the support can be achieved, in which the at least two spacer elements each have a different height in the adjusted position.

8. The vehicle headlamp according to claim 1, wherein between the light source and the support a circuit board is provided, on which the light source is fastened.

9. The vehicle headlamp according to claim 1, wherein on the support a heat sink is provided, or the support itself is provided with cooling fins or cooling pins, and the at least one light source is fastened on the support, wherein between the light source and the heat sink a circuit board is provided, on which circuit board the light source is fastened.

10. The vehicle headlamp according to claim 9, wherein the support has a passage opening, through which the light source projects.

11. The vehicle headlamp according to claim 1, wherein the support further comprises at least one recess having a depth suitable for receiving the at least one spacer element, and being shaped essentially in a manner complementary to the outer contour of the at least one spacer element, wherein the height of the at least one spacer element is greater than the depth of the at least one recess.

12. The vehicle headlamp according to claim 1, wherein a layer is applied between the at least one spacer element and the support, and/or between the at least one spacer element and the holding bracket, and/or between the at least one connector device and the support, said layer containing an adhesive, which is in a fluid state, wherein the adhesive is embedded in a number of microcapsules, and is held in a fluid carrier substrate, in which the number of microcapsules is embedded, and wherein the number of microcapsules are configured to at least partially burst and release the embedded adhesive, by virtue of the support being connected to the holding bracket by being applied a force through the at least one connector device.

13. The vehicle headlamp according to claim 1, wherein the at least one spacer element has a spacer element opening, and has a toroidal shape, and wherein the at least one connector device extends through the spacer element opening.

14. The vehicle headlamp according to claim 1, wherein the at least one connector device is a screw, and the bore of the support has a thread, which is configured to engage with the at least one connector device.

15. The vehicle headlamp according to claim 1, wherein the support comprises at least one crush ridge, which is configured to engage with the holding bracket in the adjusted state.

16. A method for the assembly and adjustment of a light source and an ancillary optical unit of a vehicle headlamp relative to one another, wherein the light source is configured to emit light through the ancillary optical unit, and the ancillary optical unit is configured to focus or shape said light, wherein the vehicle headlamp further comprises a support and a holding bracket, the method comprising the steps of:

arranging and fixing the light source in the region of a bearing surface of the support, in which a bore is provided for receiving at least one connector device, which extends in a longitudinal direction, and has an axis in the direction of the longitudinal extent, arranging at least one spacer element on the support, and a holding bracket on the spacer element, wherein the holding bracket is fixed to the ancillary optical unit and has at least one opening, which is configured to receive the at least one connector device, inserting the at least one connector device into the respective opening, and into the respective bore, establishing an initial adjustment state by orienting the ancillary optical unit relative to the light source in an XY-plane, which is defined normal to the axis, setting the initial adjustment state in the XY-plane by connecting the support and the holding bracket by exerting a first force using the at least one connector device, wherein a first adjustment state with a first adjustment height is achieved, and establishing a third adjustment state in the XY plane and in the direction of the axis by exerting a third force using the connector device between the support and the holding bracket, wherein a third adjustment height is achieved, wherein the at least one spacer element in the fixed, third adjustment state holds the support and the holding bracket at a distance from one another in order to position the light source and the ancillary optical unit in a desired alignment with respect to one another.

17. The method according to claim 16, wherein an activatable adhesive is applied to the outer surface of the at least one spacer element and/or connector device before the step of the insertion of the at least one connector device, and the following step is performed before the step of establishing a third adjustment state:

establishing a second adjustment state, wherein the adhesive is activated by exerting a second force using the connector device between the support and the holding bracket, achieving a second adjustment height, and the following step is performed after the step of establishing a third adjustment state:

setting the third adjustment state in the XY-plane and in the direction of the axis at the third adjustment height, by curing of the activated adhesive.

18. The method according to claim 16, wherein before arranging the at least one spacer element, a layer is applied between the at least one spacer element and the support and/or between the at least one spacer element and the holding bracket and/or between the at least one connector device and the support, which layer contains an activatable adhesive, which is in a fluid state.

19. The method according to claim 16, wherein the adhesive is embedded in a number of microcapsules, and is held in a fluid carrier substrate in which the number of microcapsules is embedded, and the number of microcapsules at least partially burst when a mechanical force is applied to the microcapsules, releasing the embedded adhesive.

20. The method according to claim 16, wherein the modulus of elasticity of the at least one spacer element is less than the modulus of elasticity of the holding bracket, and/or the support, wherein the modulus of elasticity of the at least one spacer element is less than 80 $kN/mm^2$, and greater than 1 $kN/mm^2$, and the yield point of the at least one spacer element is less than 100 $kN/mm^2$.

21. The method according to claim 20, wherein the modulus of elasticity of the at least one spacer element is less than 30 $kN/mm^2$.

22. The method according to claim 20, wherein the modulus of elasticity of the at least one spacer element is less than 4 $kN/mm^2$.

23. The method according to claim 20, wherein the yield point of the at least one spacer element is less than 80 $kN/mm^2$ and greater than 10 $kN/mm^2$.

24. The method according to claim 20, wherein the yield point of the at least one spacer element is less than 70 $kN/mm^2$ and greater than 20 $kN/mm^2$.

* * * * *